United States Patent [19]

Weidler et al.

[11] 4,168,874

[45] Sep. 25, 1979

[54] CONNECTOR HAVING IMPROVED PANEL MOUNTING MEANS

[75] Inventors: Charles H. Weidler, Lancaster; Richard L. Marks, Mechanicsburg, both of Pa.

[73] Assignee: AMP Incorporated, Harrisburg, Pa.

[21] Appl. No.: 879,575

[22] Filed: Feb. 21, 1978

[51] Int. Cl.[2] ..... H01R 13/00

[52] U.S. Cl. ..... 339/128; 339/99 R

[58] Field of Search ..... 339/128, 126 RS, 91 R, 339/99 R, 196, 206 R, 206 P, 206 L, 207, 209, 210

[56] References Cited

U.S. PATENT DOCUMENTS

| | | | |
|---|---|---|---|
| 3,719,917 | 3/1973 | Fischer | 339/128 R X |
| 3,828,302 | 8/1974 | Cieniawa | 339/91 R |
| 3,874,762 | 4/1975 | Shott | 339/196 R X |
| 3,903,458 | 9/1975 | Arnoux | 339/128 X |
| 3,963,319 | 6/1976 | Schumacher | 339/99 R X |
| 4,025,142 | 5/1977 | Huber et al. | 339/128 |

*Primary Examiner*—Joseph H. McGlynn
*Assistant Examiner*—John S. Brown
*Attorney, Agent, or Firm*—Frederick W. Raring

[57] ABSTRACT

Multi-contact electrical connector comprises an insulating housing having contact receiving cavities extending therethrough from a wire-receiving face to the mating face. The terminals in the cavities are of the type which receive a wire upon movement of the wire laterally of its axis and into slots in the terminals. The connector housing has a back cover which is assembled to the housing after the wires are connected to the terminals and the back cover has latch arms extending from its ends toward the mating face for mounting of the connector in an opening in a panel.

6 Claims, 9 Drawing Figures

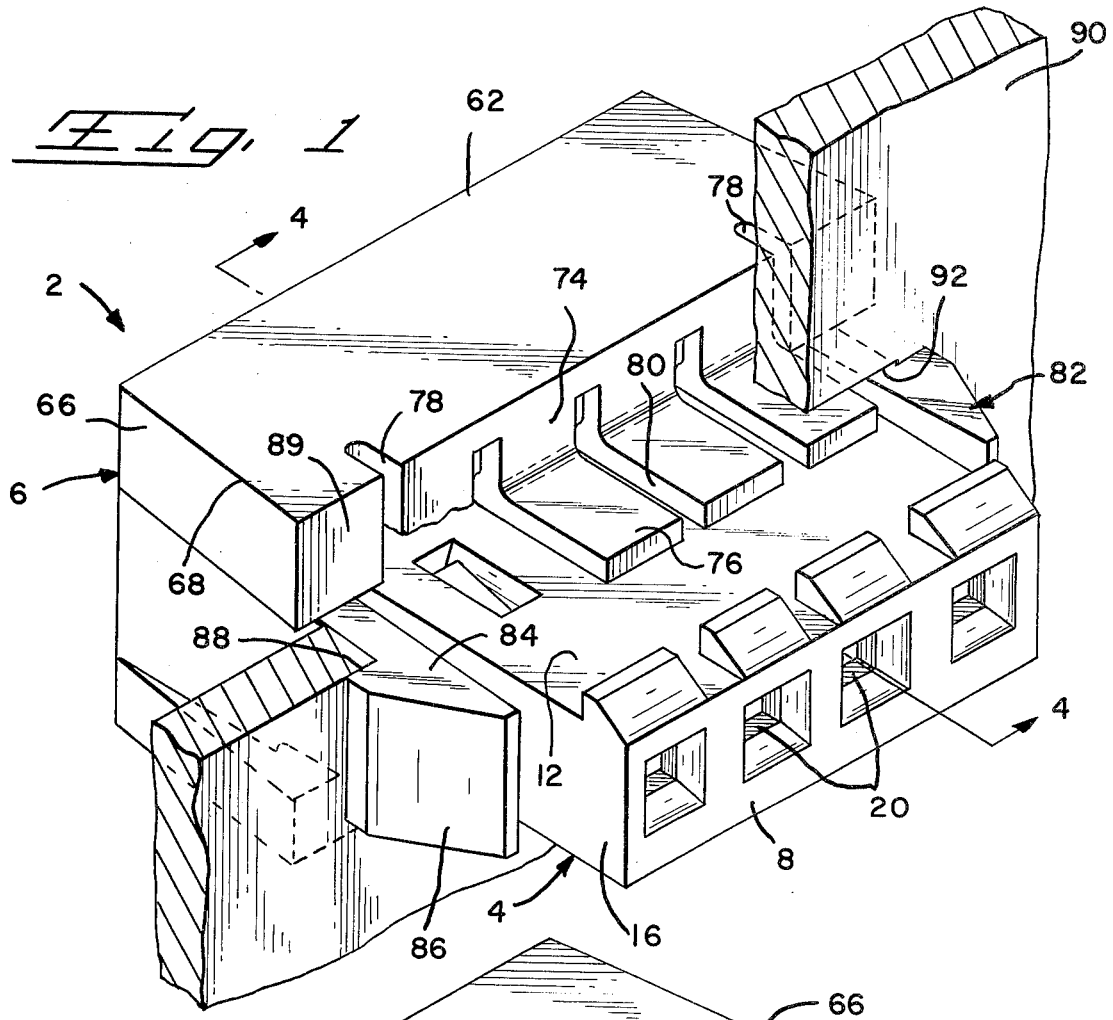
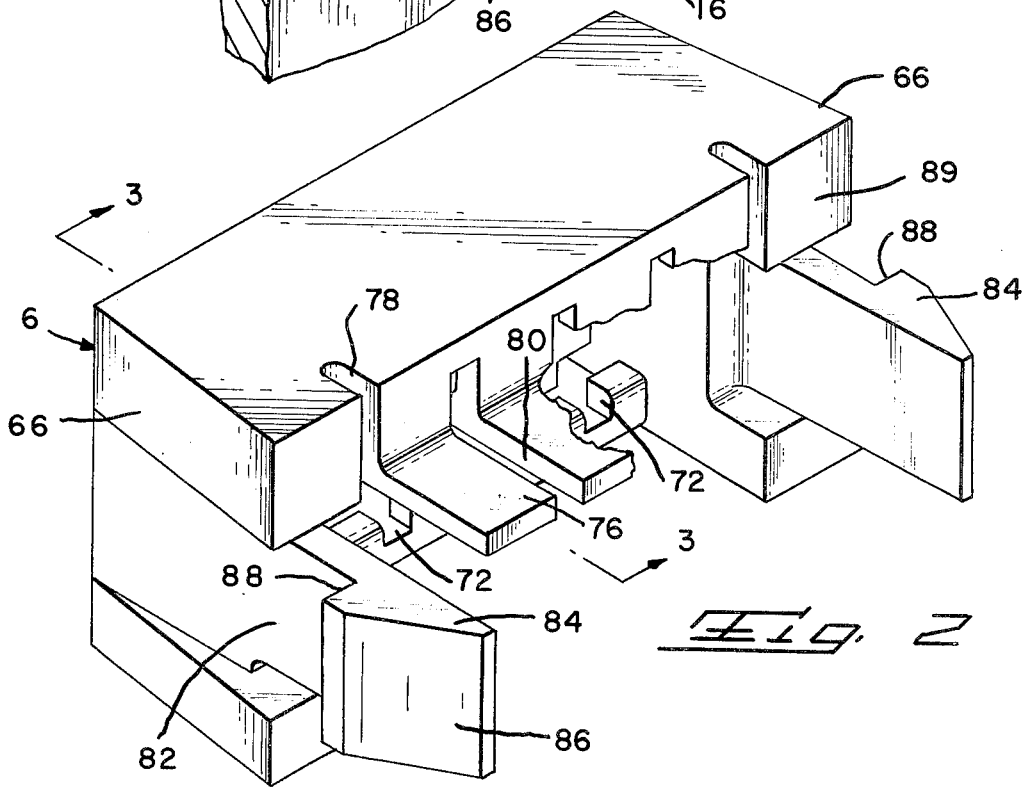
FIG. 2

CONNECTOR HAVING IMPROVED PANEL MOUNTING MEANS

BACKGROUND OF THE INVENTION

This invention relates to multi-contact electrical connectors and particularly to connectors having improved mounting means for mounting the connector in an opening in a panel.

Application Ser. No. 859,067 filed Dec. 9, 1977, discloses and claims a multi-contact electrical connector comprising an insulating housing having a mating face, a wire-receiving face, and a plurality of cavities extending through the housing from the wire-receiving face to the mating face. Contact terminals are contained in the cavities, the terminals being of the type which are adapted to receive a wire upon movement of the wire laterally of its axis and into a wire-receiving slot in the terminal. After the wire has been connected to the terminal, the wire will extend laterally through a wire-admitting slot in one of the side surfaces of the housing. The connector shown in the above identified application is being enthusiastically received and is coming into widespread use in the electrical industry.

The connector shown in application Ser. No. 859,067 is particularly intended to be mated with side-by-side terminal posts which extend from a panel board or the like. It would be desirable to use the principles of the connector disclosed in the above identified application under other circumstances, particularly, it would be desirable to provide a panel mounting means for mounting the connector in or on a flat panel so that the connector could then be disengageably mounted with a complementary connector in accordance with common wiring practice. Multi-contact connectors having integral latch arms by means of which they can be mounted in panels are widely known, see for example U.S. Pat. Nos. 2,891,103, 3,179,738 and 3,573,716. However, to provide integral latch arms on the connectors shown in application Ser. No. 859,067 would cancel out many of the desirable features of that connector. For example, one important advantage of the connector shown in application Ser. No. 859,067 is that wires can be connected to the terminals in the connector by automatic or semi-automatic wire insertion machines of the type shown, for example, in application Ser. No. 846,732, and if the connector of application Ser. No. 859,067 were redesigned so that it would have integral latch arms it could not, with convenience, be used in conjunction with these known insertion machines.

The instant invention is directed to the achievement of a separate panel mounting means which can be added to, or mounted on, an electrical connector housing after wires have been connected to the terminals in the housing of the connector. In accordance with the principles of the invention, a back cover is provided which is dimensioned such that it can be snapped over the wire-receiving face of a connector housing so as to cover the ends of the terminal receiving cavities and protect them. The back cover has flexible latch arms extending therefrom towards the mating face of the connector housing so that the connector assembly comprising the housing and the cover can readily be mounted in a panel opening by merely inserting the connector, mating end first, through the opening until the latch arms engage the edges of the opening.

The back cover in accordance with one embodiment comprises a one-piece molded part which is dimensioned to be assembled to a connector having complementary dimensions. In accordance with an alternative embodiment, an extruded back cover is provided which extends between the ends of the connector housing and separate end caps are assembled to the ends of the housing. The end caps, which are molded parts, have the latch arms integral therewith.

It is accordingly an object of the invention to provide an improved panel mounting means which can optionally be assembled to a connector housing. A further object is to provide a separate panel mounting means for a connector which is also used under circumstances where it need not be panel mounted so that the user, or harness manufacturer, can use a standard type of connector for a variety of wiring conditions and need not obtain different types of connectors for different applications.

These and other objects of the invention are achieved in preferred embodiments thereof which are briefly described in the foregoing abstract, and are described in detail below, and which are shown in the accompanying drawing in which:

FIG. 1 is a perspective view of a connector and a cover member in accordance with the invention assembled thereto.

FIG. 2 is a perspective view of the cover member.

Figure 3:
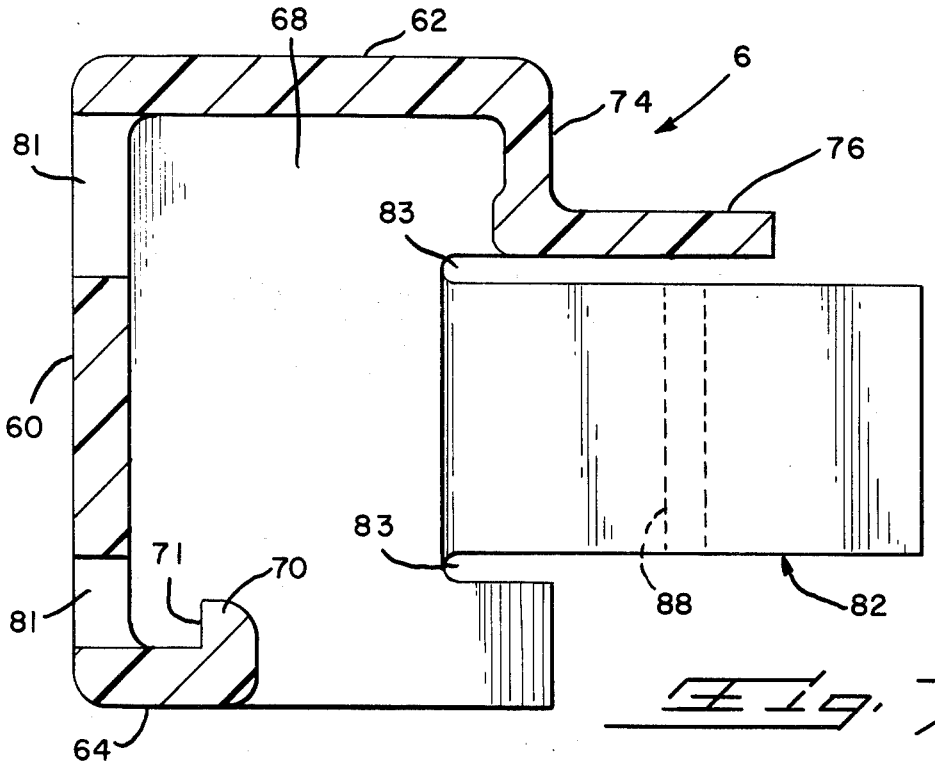
FIG. 3 is a cross-sectional view taken along the lines 3—3 of FIG. 2.
Figure 4:
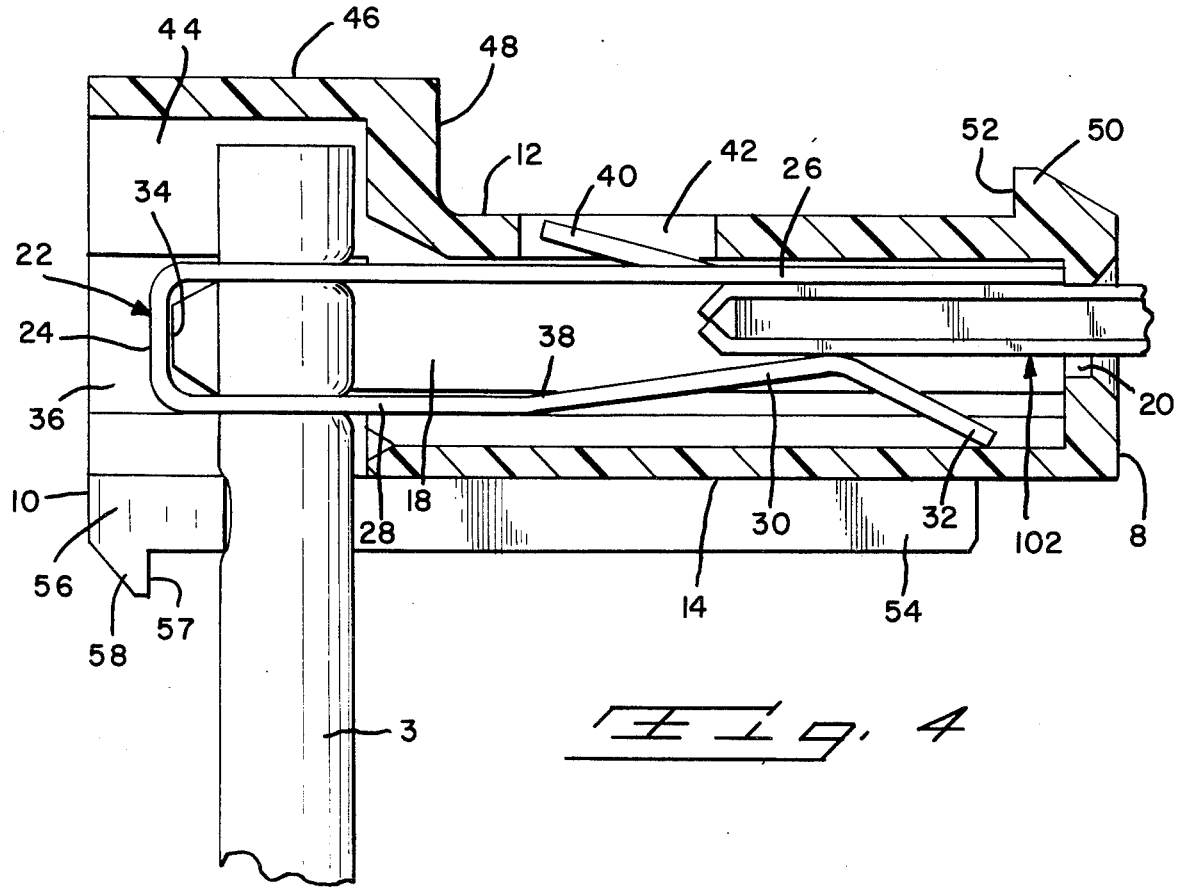
FIG. 4 is a cross-sectional view on an enlarged scale of the housing portion of the connector assembly of FIG. 1, this view being taken along the lines 4—4 of FIG. 1, but with the cover omitted.

Referring first to FIGS. 1–4, a connector assembly 2 in accordance with the invention comprises a connector housing 4 and a cover member 6 which is mounted on the rearward or wire receiving face 10 of the housing 4. The housing 4 is in the form of a rectangular insulating body which is molded of suitable thermoplastic material, such as a filled nylon. The housing has a mating face 8, an oppositely directed wire-receiving face 10, sidewalls 12, 14, and endwalls 16 which extend between the two faces. A plurality of terminal-receiving cavities 18 extend through the housing from the wire-receiving face to the mating face, each cavity having a constricted opening 20 at the mating face and a relatively large opening at the wire-receiving face 10. A terminal of the type shown at 22 is contained in each cavity, each terminal having a wire-receiving portion proximate to the wire-receiving face. This wire-receiving portion comprises a web or bight 24 and arms 26, 28 which extend from the bight towards the mating face. The arm 26 is substantially straight while the arm 28 has a contact portion which extends obliquely as shown at 30 towards the arm 26 and the end of the arm 28 is reversely bent as shown at 32.

Each terminal 22 is supported in its cavity by shoulders 34 which are provided on the opposed internal surfaces 36 of the cavity which extend normally of the sidewalls 12, 14. Additional shoulder means may be provided at 38 for cooperation with shoulders on the contact arm 28 of the terminal. Each terminal has a lance 40 struck from its arm 26 which extends into an opening 42 in the sidewall 12 to prevent withdrawal of the terminal from its cavity. The contact portion of each terminal has wire-receiving slots in the arms 26, 28 and the cavity is enlarged at the face 10 as shown at 44 to permit movement of a wire into the cavity and into the slots in the arms of the terminal. This enlargement of the cavity results in an external projection portion 46 of the sidewall 12 and a shoulder 48 which faces towards the mating face 8 of the housing. A rib 50 is provided on the sidewall 12 at the mating face and this rib in turn defines another shoulder 52 which cooperates with a latching means on a complementary connector 142, described below.

Spaced-apart ribs 54 are provided on the sidewall 14 and extend from the wire-receiving face towards the mating face. An outwardly projecting lip 58 extends from each of the ribs at the wire-receiving face, and wire-admitting slots or openings 56 are provided in the sidewall between adjacent ribs. These slots 56 permit the movement of the wires 3 laterally of their axes and into the wire-receiving portions of the terminals 22 when the connector is installed on wires and the wires therefore extend laterally through the openings 56 as shown. Advantageously, the opposed surfaces of the wire-admitting slots 56 are tapered towards each other to a constricted portion which serves as a one-way gate for the wires so that they cannot be moved outwardly of the connector from the position shown in the drawing. These constricted zones in the openings 56 thus serve as strain relief means for the wires.

It will be understood that the connector housing 4 is of the general type disclosed and claimed in the above identified application Ser. No. 859,067 with modifications and changes which adapt the connector for use with the cover means described below.

The cover 6 is in the form of a molded member having a generally U-shaped cross-section as shown in FIG. 3, which comprises a web 60 and flanges 62, 64 which extend from the side portions of the web. The flange 64 is relatively short and is dimensioned to extend over the projecting lips 58. A rib 70 extends transversely across the internal surface of the flange 64 which provides a surface 71 which engages the surface 57 of the ribs 58. The rib 70 is provided with spaced apart notches 72 which receive the ribs 54 of the housing. The flange 62 is dimensioned such that it extends over the surface of the projecting portion 46 of the housing and towards the mating face. Flange 62 is inwardly offset as shown at 74 and the end portion 76 of this flange extends along the surface of sidewall 12 and beyond the shoulder 48. Slots 78 extend into the flange 68 through the offset portion 74 as shown in FIG. 2 so that the entire projecting portion 76 can be flexed outwardly when the cover is assembled to the housing. Additional slots 80 are provided in the projecting portion which extend into the offset portion so that the individual sections of the projecting portion 76 can be individually flexed to some extent. It will be noted that the projecting portion 76 acts as a closure or cover for the openings 42 in the housing and thereby encloses and protects the tangs 40 of the terminals.

The end portions 66 of the cover comprise cover endwalls which extend over the endwalls 16 of the housing. An integral flexible latch arm 82 extends from each of these endwalls towards the mating face, each latch arm having an enlarged end 84 which is tapered on its outwardly facing surface as shown at 86 to define a latching shoulder 88 which is directed towards the web 60 of the cover. Recesses 83 may be provided in the endwalls 68 to enhance the flexibility of the latch arms. As previously noted, the cover member 6 is produced by molding of thermoplastic material and suitable openings may be provided as shown at 81 to permit optimum coring practice as required.

After the wires 3 have been inserted into the wire-receiving portions of the terminals 22, the cover 6 is assembled to the housing by merely pushing it over the wire-receiving surface until the rib 70 lodges against the shoulders 57 and the offset portion 74 is against the facing shoulder 48. The connector can then be mounted in an opening 92 in a panel 90 by merely orienting the connector properly and moving it, mating face first, through the opening until the latch arms engage the edges of the opening as shown in FIG. 1. As shown in FIG. 1, the surfaces 89 bear against one surface of panel 90 and shoulders 88 bear against the other surface.

After the connector assembly 2 has been mounted in the opening, it can be mated with a complementary connector shown at 94. This connector 94 comprises a housing 98 which has an integral hood portion 100. The housing 98 is similar in many respects to the housing 4 and need not be described in detail. Accordingly, the same reference numerals differentiated by prime marks, will be used for corresponding structural features in the housing 4 and the housing 98.

Figure 7:
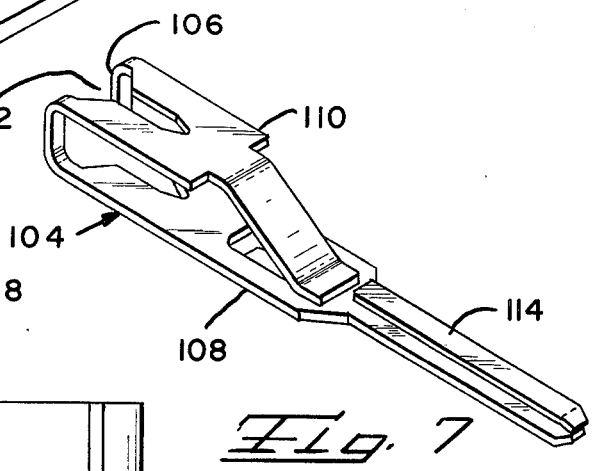
FIG. 7 is a perspective view of a contact terminal of the type contained in the connector of FIG. 6.

The terminals (FIG. 7), which are contained in the housing 98, have wire-receiving portions 104 consisting of a bight 106 and arms 108, 110 which extend from the bight. A wire-receiving slot 112 is provided for forming an electrical connection to a wire as previously described. The arm 108 extends beyond the end of the arm 110 and has a contact portion 114 which is of channel shaped cross-section to provide sufficient thickness for the contact terminals 22 in the connector 4. The arm 110 is inclined towards the surface of arm 108, and the cavity which receives the terminal of FIG. 7 is shaped to conform to the terminal as shown.

The hood 100 extends from the mating face of the housing 98 and has a hollow interior 120 into which the contact pin portions of the terminals project. The lower surface 122 of the interior of the hood is provided with spaced-apart channels or grooves 124 which are dimensioned to receive the ribs 54 of the connector housing 4 and the endwalls 128 of the hood are dimensioned snugly to receive the leading portion of the housing 4 with sufficient clearance for the projecting rib 50. The ribs 54 and the grooves 124 serve to polarize the two connector parts when they are mated. The wire-receiving face 10 of the connector 98 is provided with an extruded cover 142 which is described below in conjunction with the description of the alternative embodiment of the invention shown in FIGS. 8 and 9.

Figure 5:
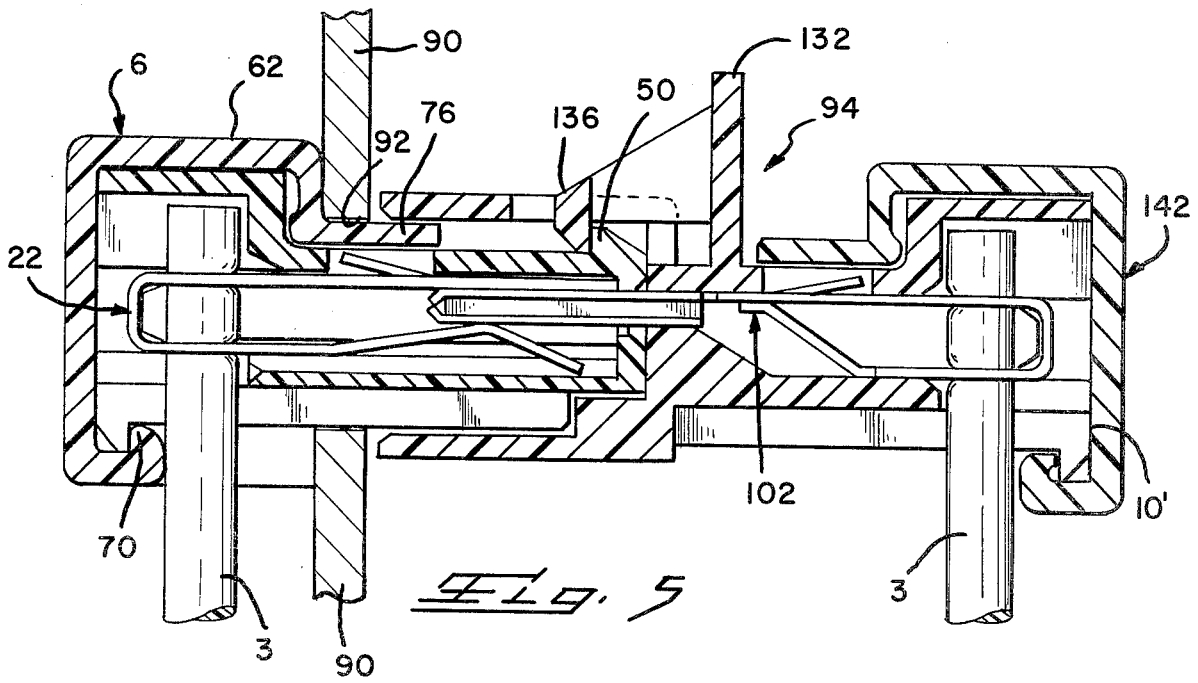
FIG. 5 is a sectional side view showing the connector mated with a complementary connector.
Figure 6:
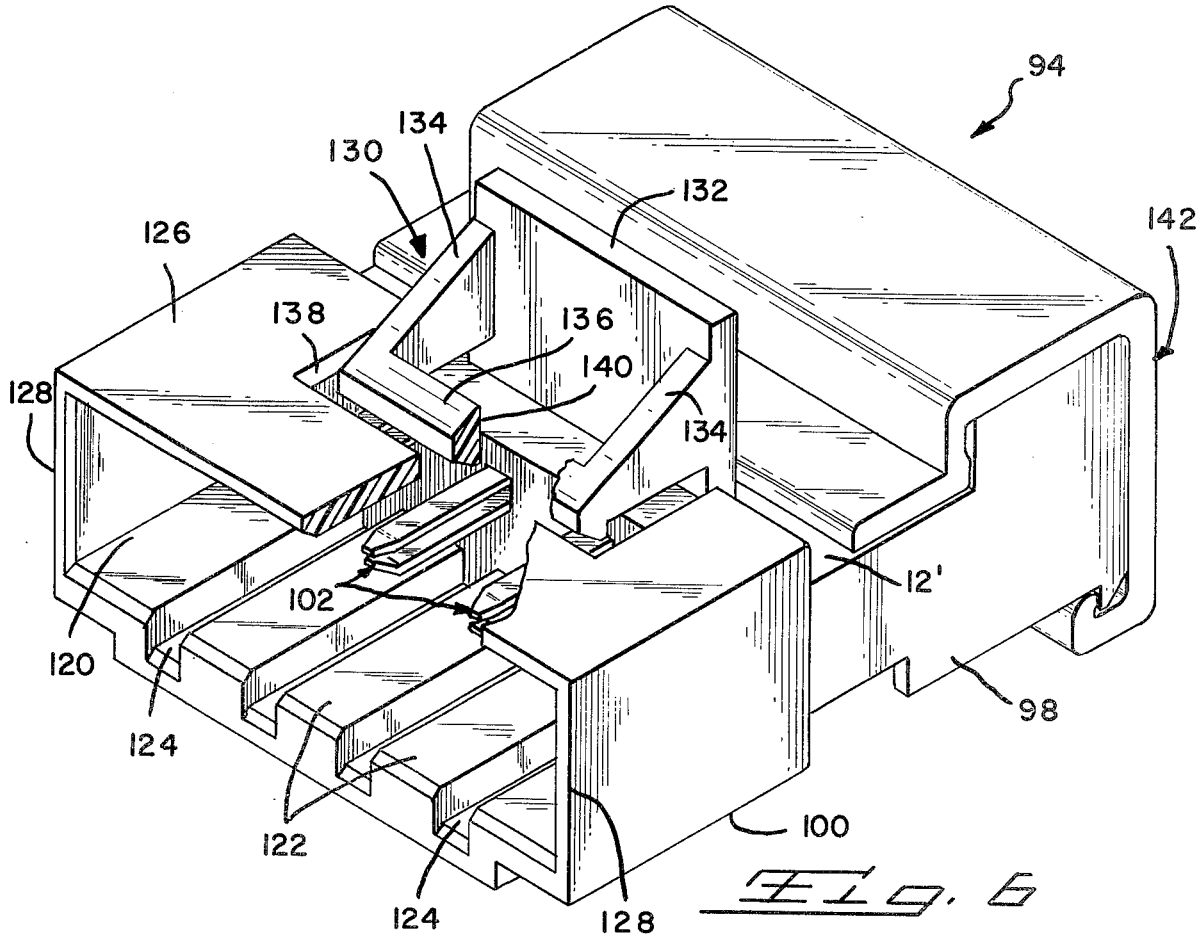
FIG. 6 is a perspective view of a complementary connector, shown in FIG. 5, which is dimensioned to be mated with the connector of FIG. 1.

When the connector 94 is mated with the panel mounted connector assembly 2, the two connectors are disengageably latched to each other by latching means 130 comprising a flexible support 132 which extends integrally from the surface 12' and which has a pair of spaced-apart support arms 134 extending towards the free end of the hood. A latching bar 136 extends between, and is integral with, the ends of the arms 134 and provides a latching or locking surface 140 which faces the support member 132. An opening 138 is provided in the top wall 126 of hood 100 through which the latching bar projects as shown in FIG. 6. It will be apparent that when the connectors are mated with each other, the latching bar 136 will be flexed upwardly by the inclined surface of the rib 50 and will then return to its normal position when the connector parts are fully mated, as shown in FIG. 5. When the connector 94 is to be disengaged from the connector 2, it is merely necessary to flex the support 132 in a clockwise direction as viewed in FIG. 5 to disengage the latching bar 136 from the rib 50.

Figure 8:
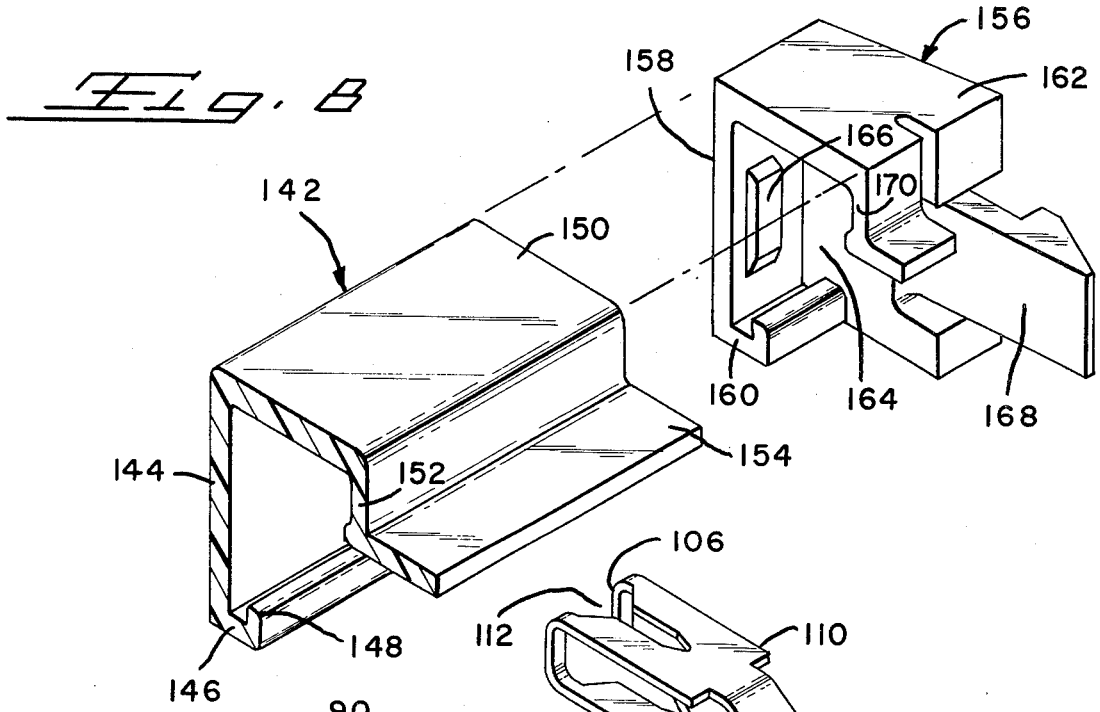
FIG. 8 is a perspective view of a cover means in accordance with an alternative embodiment of the invention.
Figure 9:
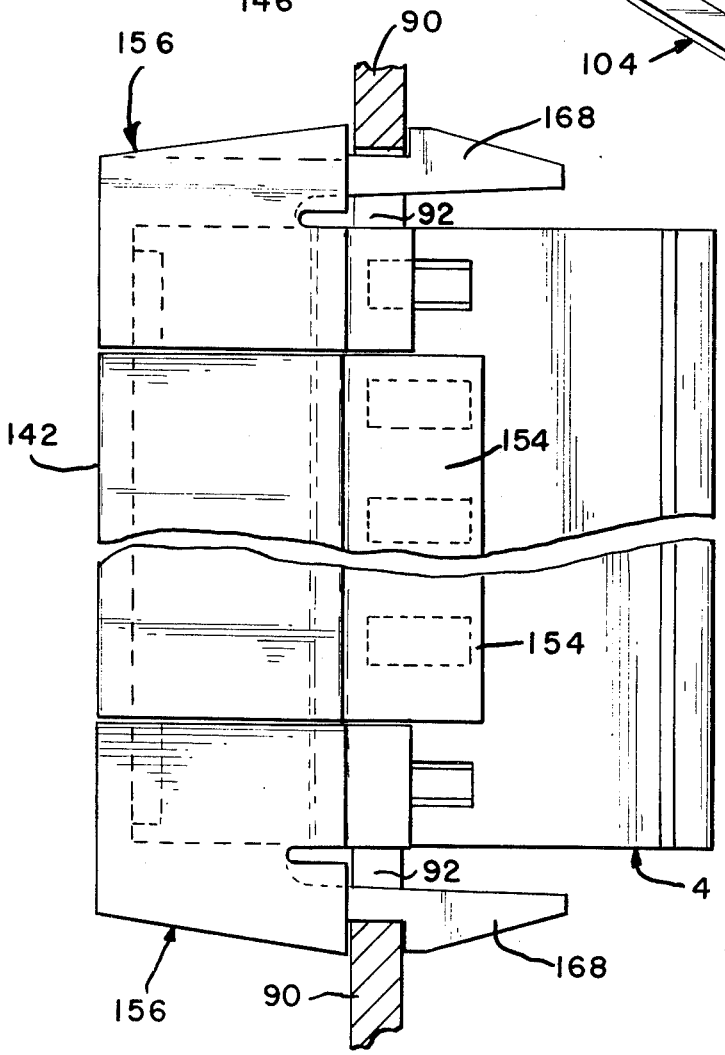
FIG. 9 is a plan view of the alternative embodiment.

FIGS. 8 and 9 show an alternative embodiment of the invention in which the cover for the wire-receiving face of the connector comprises the extruded cover member 142 and a pair of molded end covers 156. The extruded cover 142 is of uniform cross-section throughout its length and comprises a web 144, a short flange 146 and a long flange 150 which has an inwardly offset portion 152 and an inwardly displaced lower end 154. The cover 142 is produced as a continuous extrusion and can simply be cut to the desired length for a particular connector when it is not required, as in FIG. 5, that the latching arms be provided. Thus a simple extruded cover 142 is provided on the complementary connector 94 rather than a higher cost molded cover.

Latching means, in accordance with the invention, can be provided optionally however, by using the extruded cover 142 and the end covers 156. These end covers are mirror images of each other and each comprises a web 158, short and long flanges 160, 162, and an endwall 164. It will be apparent that the flanges 160, 162 are essentially similar to the flanges of the molded cover described above and the covers can therefore be assembled to the ends of a housing in the manner described above. Advantageously, a boss 166 is provided on the internal surface of the web 158. This boss is dimensioned to enter the cavity which is adjacent to the end of the housing and serves to stabilize the end cover 156 on the housing. Each end cover has a latch arm 168 extending from its endwall, these latch arms being essentially similar to the latch arms previously described. The flange 162 is offset as shown at 170.

A comparative advantage of the embodiment shown in FIGS. 8 and 9 is that a standard extruded cover 142 can be used with two standard end cover members 156 for any connectors of different sizes. In other words, it is not necessary to mold a specific cover member 6 for each size connector; if a back cover having latching means is required for a six position connector, it is merely necessary to cut an appropriate length of extruded cover to the connector, and then assemble the end covers to the housing.

The principles of the invention can be used for many types of connectors other than the types shown in the drawing and they can be used for panel mounting connectors under circumstances other than those illustrated. For example, if it is desired to mount the connector on the panel with the mating face of the connector against the surface of the panel, a pair of spaced-apart holes can be punched in the panel and the latching arms lengthened so that they extend beyond the mating face. The connector can then be mounted in the panel by merely inserting the ends with the latch arms through the openings.

What is claimed is:

1. In an electrical connector assembly of the type comprising a molded insulating housing having a mating face and a wire-receiving face, laterally directed external walls extending between said faces, a plurality of terminal-receiving cavities extending through said housing from said wire-receiving face to said mating face, each of said cavities having a terminal therein, each of said terminals having a wire-receiving portion proximate to said wire-receiving face, wires in said wire-receiving portions, said terminals through wire-admitting slots in said walls, the improvement to said connector comprising:

cover means in covering relationship to said wire-receiving face, said cover means and said housing having interengaging means serving to retain said cover means on said housing, said cover means having latch arms integral therewith extending along said external walls, said latch arms being normally spaced from, and being flexible towards, said external walls of said housing whereby, said connector can be mounted in a panel opening by flexing said latch arms towards said housing and moving said housing, mating face first, through said opening until said latch arms engage said panel.

2. A connector assembly as set forth in claim 1, said external walls comprising generally rectangular sidewalls and rectangular endwalls, said latch arms extending along said endwalls.

3. In an electrical connector assembly of the type comprising a molded insulating housing having a mating face and a wire-receiving face, oppositely directed endwalls and oppositely directed sidewalls extending between said faces, a plurality of side-by-side terminal-receiving cavities extending through said housing from said wire-receiving face to said mating face, said cavities being arranged in a row which extends between said endwalls, each of said cavities having a contact terminal therein, each of said terminals having wire-receiving portion proximate to said wire-receiving face, wires disposed in said wire-receiving portions, said wires being oriented with their axes extending substantially normally of said sidewalls and from said wire-receiving portions of said terminals through wire-admitting slots in at least one of said sidewalls, the improvement to said connector comprising:

cover means in covering relationship to said wire-receiving face, said cover member having a web portion and first and second flanges extending from marginal side portions of said web portion, said web portion being against said wire-receiving face, flanges extending over said sidewalls, said cover means having cover endwalls disposed against said endwalls of said housing, each of said cover endwalls having a flexible latch arm extending therefrom and along the associated housing endwall towards said mating face, each of said latch arms having a free end and having latching hook means on said free end, said cover means and said connector housing having interengaging means thereon serving to hold said cover means on said housing whereby, said connector can be mounted in a panel opening having a width which is substantially equal to the distance between said latch arms by flexing said latch arms towards their associated housing endwalls and moving said connector, mating face first, through said opening until said latch arms engage said panel.

4. A connector assembly as set forth in claim 3, said cover means comprising a one piece molding.

5. A connector assembly as set forth in claim 3, said cover means comprising an extruded center section and two molded end sections, said end sections having said cover endwalls and latch arms integral therewith, said center section extending between said end sections.

6. A connector assembly as set forth in claim 3, at least one of said sidewalls having a row of openings therein, each of said openings communicating with one of said cavities, each of said terminals having a retaining lance extending therefrom and into the associated opening, said cover means extending over, and serving to close, said openings.

* * * * *